US006269318B1

(12) United States Patent
Geddes

(10) Patent No.: US 6,269,318 B1
(45) Date of Patent: Jul. 31, 2001

(54) METHOD FOR DETERMINING TRANSDUCER LINEAR OPERATIONAL PARAMETERS

(76) Inventor: Earl R. Geddes, 1388 Medinah Dr., Itasca, IL (US) 60143

( * ) Notice: Subject to any disclaimer, the term of this patent is extended or adjusted under 35 U.S.C. 154(b) by 0 days.

(21) Appl. No.: 09/058,441

(22) Filed: Apr. 9, 1998

Related U.S. Application Data

(60) Provisional application No. 60/044,299, filed on Apr. 30, 1997.

(51) Int. Cl.[7] ..... H04R 3/00; H04R 29/00

(52) U.S. Cl. ..... 702/109; 381/150; 324/615; 324/629

(58) Field of Search ..... 702/109, 65, 86, 702/103, 107; 324/612, 615, 629; 73/1.82, 645; 381/95, 96, 150

(56) References Cited

U.S. PATENT DOCUMENTS

| | | | | |
|---|---|---|---|---|
| 3,912,880 | * | 10/1975 | Powter et al. | 179/175.1 A |
| 4,209,672 | * | 6/1980 | Nitta et al. | 179/175.1 |
| 4,284,860 | * | 8/1981 | Leach, Jr. et al. | 179/175.1 |
| 4,403,112 | * | 9/1983 | Modafferi | 179/1 E |
| 4,909,064 | * | 3/1990 | Talmadge | 73/4 R |
| 5,181,251 | * | 1/1993 | Schultheiss et al. | 381/96 |
| 5,361,305 | | 11/1994 | Easley . | |
| 5,438,625 | * | 8/1995 | Klippel | 381/96 |
| 5,491,753 | | 2/1996 | Van Hoot . | |
| 5,792,072 | * | 8/1998 | Keefe | 600/559 |

OTHER PUBLICATIONS

Various Internet Pages From: www.etfacoustic.com, Date Unknown.*

Thiele "Loudspeakers in Vented Boxes: Part 1" Loudspeaker Anthology—AES Orginally–Proceediongs of the IREW Australia, vol. 22 p. 487 Aug. 1961.

Small "Direct–Radiator Loudspeaker System Analysis" Loudspeaker Anthology–AES Orginally—IEEE Transactions on Audio and Electroacoustics vol. AU–19 p. 269, Dec. 1971.

Jeong "Harmonic Balance Methode for Estimating the Non–Linear Parameters of Electro Dynamic Direct Radiator Loudspeakers" Journal of the Audio Engineering Society vol. 44 #4, Apr. 1996.

Phillips "Efficient Loudspeaker Linear and Non–Linear Parameter Estimination" AES Preprint #3164 Presented at the 93rd AES Convention, Oct. 1992.

* cited by examiner

*Primary Examiner*—Patrick Assouad

(57) ABSTRACT

An apparatus and method for determining a transducers principle operating parameters which utilizes two transfer functions; 1) the transfer function from the pressure response (50) to the voltage drop across the transducer (60); and 2) the transfer function from the pressure response (50) to the current flow through the transducer(70). The parameters of simple filter equations are fitted to these measured response curves. The transducers operating parameters are then calculated directly from the fitted parameters of the filter equations. Several methods for measuring the pressure and determining the appropriate filter equations are shown.

12 Claims, 4 Drawing Sheets

METHOD FOR DETERMINING TRANSDUCER LINEAR OPERATIONAL PARAMETERS

This application claims benefit of Provisional application 60/044,299, filed Apr. 30, 1997.

BACKGROUND

1. Field of the Invention

The present invention relates to acoustical transducer measurement methodology and apparatus utilizing efficient techniques for assessing their linear operational parameters.

2. Description of Prior Art

The use of any transducer usually involves a measurement of its operating parameters, principally its moving mass, support compliance, motional resistance(mechanical), electrical input impedance, force coupling factor and any other such parameter as required to determine its operational characteristics. This measurement is often done on prototype samples to determine if they meet design intent, on production units as a quality control measure, or for any number of other reasons. The specific unit being investigated will be called the Device Under Test or DUT.

Numerous techniques are in use today for measuring the transducers operational parameters. The most commonly used approach is probably the method (or a derivative of it) proposed by Neville Thiele in his landmark article on loudspeaker enclosure designs "Loudspeakers in Vented Boxes" which can be found in the Audio Engineering Society's *Loudspeaker Antholog* series. This paper is also published in the *Proceedings of the IRE Australia*, vol. 22, pp. 487–508.

The method of Thiele, which has come to be known as the Thiele-Small method and the parameters which are derived from it, the Thiele-Small parameters, are very useful in the design and utilization of electro-acoustic transducers, most notably, loudspeakers. (Small also published the use of Thiele's technique in his paper on "Closed-Box Loudspeaker Systems" also found in *Loudspeaker Anthology*.) Similar techniques can also be extended to the measurement of transducers used for hearing aids or other applications.

Once a sufficient set of operational parameters is known a relatively accurate prediction of the transducers performance can be determined. The requirement for this accurate prediction is usually that the frequency be low enough so that the wavelengths of the sound are greater than the size of the transducer itself. This is the so called "lumped parameter" region where simplified elements like resistors, inductors, capacitors, transformers, etc. can be used to represent the functionality of the real parameters, moving mass, support stiffness, motional resistance, force coupling factor and cone area, for example. The fundamental problem in determining the performance then becomes that of determining the values of the analogous components of resistance, inductance, etc. By measuring the readily available input impedance of the DUT and perturbing its mechanical system with either an added mass, an added compliance or some other perturbation, the operational parameters of the DUT can be calculated. This is basically the Thiele-Small method.

In many embodiments of the prior art the impedance of the circuit shown in FIG. 1 is measured. The system is perturbed and the impedance is measured again. From the shift in the resonance frequency which results from the know perturbation the moving mass and the support stiffness can be determined. This determination can be done by finding certain key frequencies such as resonance and the "half power points" of the motional impedance curve. The calculation of the values of electrical resistance ($R_e$), electrical inductance ($L_e$), force factor (Bl) cone mass ($M_m$), support compliance ($C_m$), motional resistance ($R_m$), and radiating area ($S_d$) is done by techniques shown in the prior art. These operational parameters can also be given in the analogous (Thiele-Small) parameters of resonance frequency ($f_s$), electrical Q ($Q_e$), mechanical Q ($Q_m$), cone area ($S_d$) and electrical resistance ($R_e$). These two differing sets of operational parameters are completely equivalent being related to each other by a simple set of equations. It makes no difference which set is used in the derivation or analysis discussed in this application.

Phillips and Geddes, in "Efficient Loudspeaker Linear and Nonlinear Parameter Estimation" (presented at the *Audio Engineering Society* conference in October 1991, preprint #3164), described the use of the same lumped parameter circuit of Thiele but improve upon the measurement by "fitting" a complex curve to the measured data thereby utilizing more degrees of freedom in the analysis and reducing the expected error.

Jang and Kim disclose in their January 1994 JAES paper, vol.42, no. 1, "Identification of Loudspeaker nonlinearities Using the NARMAX Modeling Technique" the use of the input voltage signal and the cone motion, sensed via a laser, to determine the linear and nonlinear parameters. This was accomplished by means of a time domain fitting strategy which calculated the linear parameters with a low level input signal and the nonlinear parameters with a high level input signal. The input signal was Gaussian noise.

Easley et al. Disclose in AUTOMATED SYSTEM AND METHOD FOR AUTOMOTIVE AUDIO TESTING #5,361,305, a method for the rapid testing of an audio system in a vehicle. The system determines the functionality of the various channels and transducers but does not determine the transducer parameters.

Van Hout et al. disclose in METHOD AND DEVICE FOR TESTING FOR AUDIO INDUCED SYMPATHETIC BUZZES #5,491,753 the use of a standard test signal for diagnosing a buzz problem in the passenger compartment of a vehicle. No transducer parameters are determined.

Jeong and Ih teach in their April 1996 JAES paper, vol.44, No. 4, "*Harmonic Balance Method for Estimating the Nonlinear Parameters of Electrodynamic Direct-Radiator Loudspeakers*" that both the voltage and the current signal can be measured at one time thus eliminating the need for a perturbed mechanical system. A laser is used to directly detect the motion of the loudspeaker diaphragm. In this prior art discrete frequencies are used and the levels of the harmonics of these frequencies are determined. This data is used to calculate the linear and nonlinear parameters of the loudspeaker. The technique disclosed in this article is expensive to implement due to the use of the laser for output motion of the radiating surface. This method suffers from extremely complicated mathematical analysis.

Scott, Kelly and Leembruggen in "*New Method of Characterizing Driver Linearity*" in JAES Vol. 44, No. 4, April 1996 teach the use of a DC current to force the loudspeaker diaphragm off center in order to determine the linear and nonlinear parameters. By sensing the cones static displacement the force factor is determined. Once this is known the values of each of the other parameters can be calculated from the input impedance curve of the loudspeaker. This method suffers from the same set of drawbacks as the previous two, namely laborious, time consuming setup and expensive equipment.

Most recently, April 1997, Clark disclosed in "*Precision Measurement of Loudspeaker Parameters*" JAES, Vol. 45, no. 4, a straightforward direct measurement of the nonlinear loudspeaker parameters. This technique utilizes the same rear enclosure pressure method for diaphragm displacement as that used by Phillips and Geddes. Like other recent researchers Clark uses a laser as a displacement sensing device.

All of these prior art methods suffer from one or more of the following problems:

- two measurements must be taken, which cannot be done simultaneously since either the mechanical system must be perturbed. The inherent assumption is that the system does not change from one measurement to the next (which is hard to impossible to control). Another key assumption is that when a parameter is perturbed, such as the cone mass by adding mass to it, or the compliance by placing the DUT in another box, or by loading the DUT with a different length of tubing such as used for hearing aid transducers, that this perturbation affects only that parameter intended to be effected. Experience has shown that this is seldom the case. Different values of perturbation nearly always lead to differing values of the derived operational parameters, a clear sign that more than one parameter is being perturbed.
- perturbation techniques usually require access to the elements of the DUT itself. For example to add mass to the cone requires access to the cone. The switching of gravity technique requires access to the cone to feedback the cone position into a servo control system or some other method of displacement sensing. It is often desirable to measure a transducer without the need to detach any of its attached parts, such as front grille or front cover, etc. It is also desirable to measure the parameters in-situ in order to determine the loudspeaker performance under real world conditions The perturbed load (changing rear volume) technique does not require access to the internal parts, but suffers from a mixed change (radiation mass and compliance) as well as cannot be done in-situ.
- expensive and cumbersome equipment is often required. It would be desirable to have a method which could utilize readily available Personal Computer (PC) "sound cards" or other PC data acquisition boards to acquire the data. This means that only simple measurements of voltage, current and sound pressure are possible.
- most techniques require multiple measurements and these measurements can be very time consuming. Any method used as a production quality control gauge must be extremely fast and require virtually no human intervention.

OBJECTS AND ADVANTAGES

The object of this application is to show an improved method for determining a transducers linear operational parameters. The technique as disclosed herein has several advantages. In the present invention no system modification or perturbation of the DUT is required and as such the measurements are free from the questionable assumption that only one parameter has changed from test to test. The entire set of operational parameters can be determined at one time from a single system excitation comprising two different transfer functions. These transfer functions can be measured simultaneously, with minimal perturbation of the system, or separately, if multi-channel capability is not available. If the two transfer functions are obtained simultaneously, the system cannot have changed from measurement to measurement as all of the required data is taken at one time. Even if two separate transfer functions are measured separately the system need not be handled in any way and the tests can be performed without the need to assemble or dissemble, attach or detach any part, or parts. With a three channel measurement capability no intervention is required at all and the entire measurement can be accomplished in a mater of minutes. This technique can be also be used on assembled units, in enclosures etc.

In its preferred embodiment the system uses a computer with one or two PC sound cards to acquire and process the data. All of the requisite signal generation and acquisition are readily available as PC peripherals at very low cost. The transfer function and post processing calculations can be done within the computer for a fast, low cost, compact and accurate measurement of a transducers operating characteristics. No expensive equipment is required, and only standard measures of current, voltage and pressure are required.

The very rapid determination of the parameters in the present invention allows for the tracking of the operational parameters of the DUT as the system is heated from the electrical input signal. This measurement would yield the thermal characteristics of the DUT in a way not currently obtainable. The voice coil temperature an be determined from the voice coil resistance and its known resistivity change with temperature.

DRAWING FIGURES

REFERENCE NUMERALS IN DRAWINGS

1 Microphone
2 Device Under Test (DUT)
3 Test enclosure
4 Test Baffle
30 Input signal
40 Amplifier
50 Microphone signal
60 Means for sensing Voltage drop across DUT
70 Means for sensing Current flow through DUT
80 Current sense resistor

SUMMARY

In accordance with the present invention a method is shown for determining an electro-acoustic transducers operational parameters by measuring transfer functions from an electrical input to the radiated pressure, fitting these transfer functions to predetermined filter responses and calculating the operational parameters from the fitted filter coefficients.

DESCRIPTION

Figure 1:
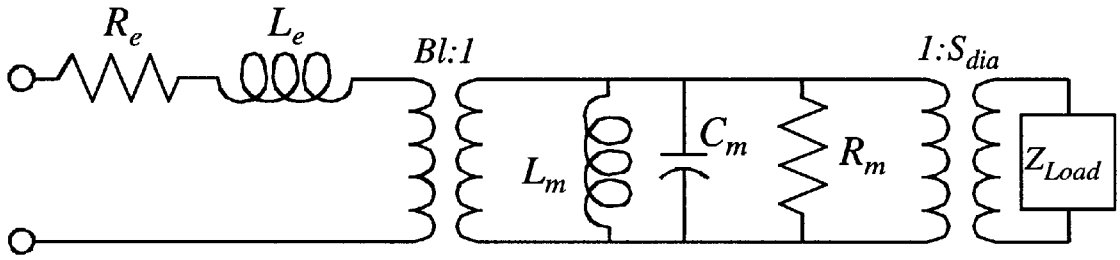
FIG. 1 shows a schematic drawing simplified lumped parameter transducer.

Referring to FIG. 1 there is shown the analogous lumped parameter electrical equivalent circuit for a typical transducer used by Thiele, Small, etc. In this circuit the first two elements are the drive coils electrical resistance and inductance. These two quantities can be measured in a straightforward manner using any of the current standard practices in electrical measurement. They can also be determined from the transfer function between the sensed voltage and sensed current into the DUT, data which is already available in a multi-channel setup. The first transformer turns ratio, Bl, represents the product of the flux density and the length of the wire in this flux density. Most accurately it is an integral of the dot product of the magnetic flux density and the incremental wire length dl as:

$$Bl=\int \text{Flux}\cdot dl$$

along the entire length of the voice coil wire.

The parallel elements between the two transformers represent the moving mass—as a capacitor with value equal to the moving mass, the motional resistance—as the inverse of the mechanical resistance and the support compliance—as an inductor with value equal to the inverse of the compliance value.

The final transformer represents the transformation of cone motion into radiated sound. The turns ratio here is the cone area, $S_d$. The cone area is usually measured directly, using a scale, by including one third of the suspension area In the present invention this area can be determined in a similar manner. Fortunately, in the lumped parameter region of primary interest the cone area is highly stable, readily determined and linear.

EQ. 1, shows the T-Matrix approach to transducer modeling that forms the basis for the current invention. The individual T-matrices represent specific components or legs in the circuit of FIG. 1. These individual matrices are progressively multiplied together, just as they appear in the device to form a single matrix which represents the DUT. This matrix method of transducer modeling is used, for example, in the commercially available loudspeaker simulation programs by Earl R. Geddes known as Speak for Windows and Speak_32. This approach has not been previously used in the assessment of transducer operational parameters.

$$[Input]=\begin{bmatrix} T\ Matrix \\ Electical \end{bmatrix}\cdot\begin{bmatrix} BL \\ Gyrator \end{bmatrix}\cdot\begin{bmatrix} T\ Matrix \\ Mechanical \end{bmatrix}\cdot\begin{bmatrix} Area \\ transformer \end{bmatrix}\cdot[Output] \quad (1$$

-continued $$\begin{bmatrix} E(\omega) \\ I(\omega) \end{bmatrix}=\begin{bmatrix} 1 & R_e+i\cdot\omega\cdot L_e \\ 0 & 1 \end{bmatrix}\cdot\begin{bmatrix} 0 & Bl \\ Bl & 0 \end{bmatrix}\cdot\begin{bmatrix} 1 & R_m+i\cdot\omega\cdot M_m+\dfrac{1}{i\cdot\omega\cdot C_m} \\ 0 & 1 \end{bmatrix}\cdot\begin{bmatrix} \dfrac{1}{S_d} & 0 \\ 0 & S_d \end{bmatrix}\cdot\begin{bmatrix} P(\omega) \\ U(\omega) \end{bmatrix}$$

The matrix form shown in EQ. 1 has been modified slightly from the circuit form shown FIG. 1. The force coupling is represented by a gyrator in EQ. 1 and as a transformer in FIG. 1. This change facilitates the more direct and intuitive use of a series set of mechanical parameters. It can be shown that either form will give the same set of equations derived in the following figures and text.

In EQ. 2, the anaytical multiplication of the various stages of the T-matrices shown in EQ. 1 has been performed.

$$\begin{bmatrix} E(\omega) \\ I(\omega) \end{bmatrix}=\begin{bmatrix} (R_e+i\omega L_e)\dfrac{S_d}{Bl} & \dfrac{-L_e\cdot M_m\cdot\omega^2+i\cdot\omega\cdot(L_e\cdot R_m+R_e\cdot M_m)+\left(R_e\cdot R_m+Bl^2+\dfrac{L_e}{C_m}\right)+\dfrac{R_e}{i\cdot\omega\cdot C_m}}{Bl\cdot S_d} \\ \dfrac{S_d}{Bl} & \dfrac{\dfrac{1}{i\cdot\omega\cdot C_m}+R_m+i\cdot\omega\cdot M_m}{Bl\cdot S_d} \end{bmatrix}\cdot\begin{bmatrix} P(\omega) \\ U(\omega) \end{bmatrix} \quad (2$$

The set of linear equations shown in EQ. 2 represents the same analytical form as would be obtained from the circuit in FIG. 1 using any other method of analysis. The primary difference is that the matrix approach explicitly shows the two input variables (voltage E(ω) and current I(ω) and two output variables (pressure P(ω) and volume velocity U(ω) which are an inherent feature of the T-matrix approach to the transduction problem.

By noting that the radiation impedance for any configurations of radiation is fixed by the configuration it should be noted that the two output variables are not independent since the pressure and volume velocity must be related by this known (or determinable) radiation impedance $Z_{load}$ as $$Z_{load}(\omega)=\frac{P(\omega)}{V(\omega)}.$$

This results in the possible elimination of either the pressure or the volume velocity in the EQ. 2.

It should be noted that the present novel measurement technique is independent of the form of the load placed on the DUT. Different load conditions may result in slightly different equations, however, the analysis procedure would remain virtually identical.

It should also be noted that some of these different loads may be dictated by the DUT. For example a hearing aid transducer does not radiate sufficient sound to allow for a free space measurement, hence they are most effectively measured using a small tube or volume. In this situation the impedance for this load is simply substituted in the equations in a manner identical to that which will be shown shortly. Further, some loading conditions may also give better results in particular situations. A noisy lab, or manufacturing plant may be better suited to the use of a closed box load where the microphone for measuring the radiated sound pressure is placed inside the box. The availability of an anechoic chamber or the requirement to use a standard setup may dictate other loading conditions and test configurations. Their associated benefits will be apparent to those skilled in the art.

As a first example and the preferred embodiment, the pressure inside of a closed, rigid, box of known volume V which contains the DUT is measured. It can be shown that the pressure and volume velocity inside of the box in this configuration will be related as $$P(\omega) = i\omega \cdot \frac{\rho \cdot c^2}{V} \cdot U(\omega) \quad (3$$

Using EQ. 3 in EQ. 2 to eliminate the diaphragm volume velocity will yield:

$$\begin{cases} E(\omega) = \left( \cdot R_e \frac{S_d}{Bl} + \frac{i \cdot \omega \cdot R_e \cdot M_m + (R_e \cdot R_m + Bl^2) + \frac{R_e}{i \cdot \omega \cdot C_m}}{Bl \cdot S_d} \right) \cdot \frac{i \cdot \omega \cdot \rho \cdot c^2 \cdot P(\omega)}{V} \\ I(\omega) = \left( \frac{S_d}{Bl} + \frac{\frac{1}{i \cdot \omega \cdot C_m} + R_m + i \cdot \omega \cdot M_m}{Bl \cdot S_d} \right) \cdot \frac{i \cdot \omega \cdot \rho \cdot c^2 \cdot P(\omega)}{V}. \end{cases} \quad (4$$

Rewriting EQ.4 in terms of the transfer functions from the voltage and current to the pressure in the box will yield $$\begin{cases} \frac{P(\omega)}{E(\omega)} = \frac{\frac{Bl \cdot S_d \cdot C_{ab}}{C_b \cdot R_e}}{1 - M_m \cdot C_{ab} \cdot \omega^2 + i \cdot \omega \cdot \left( R_m + \frac{Bl^2}{R_e} \right) \cdot C_{ab}} = \frac{f}{1 - e \cdot \omega^2 + i\omega \cdot b} \\ \frac{P(\omega)}{I(\omega)} = \frac{\frac{Bl \cdot S_d \cdot C_{ab}}{C_b}}{1 - M_m \cdot C_{ab} \cdot \omega^2 + i \cdot \omega \cdot R_m \cdot C_{ab}} = \frac{g}{1 - e \cdot \omega^2 + i\omega \cdot d} \end{cases} \quad (5$$

where $$C_b = \frac{V}{\rho \cdot c^2}, \text{ and } C_{ab} = \left( \frac{1}{C_m} + \frac{S_d^2}{C_b} \right)^{-1}.$$

The last two defined terms are simply the acoustic compliance of the test box and the mechanical compliance of the DUT as installed in the test box.

The set of EQs. 5 represent the readily obtained transfer functions from the input voltage and current to the pressure inside of the box. They are complex functions of frequency. Even simpler equations result by substituting the parametric values for the DUT (i.e. $R_{ms}$, $R_e$, Bl, . . .) by constants b, d, e, f and g as shown in the right hand side of EQ. 5. The set of variables b, d, e, f and g are uniquely defined by the parameters of the DUT ($R_e$, . . . $S_d$).

The cross-spectra (transfer functions) which must be calculated for use in EQ. 5 can be obtained in numerous ways. Those skilled in the art will find this measurement readily obtainable for instance with an FFT analyzer or a software program on a PC.

Figure 2:
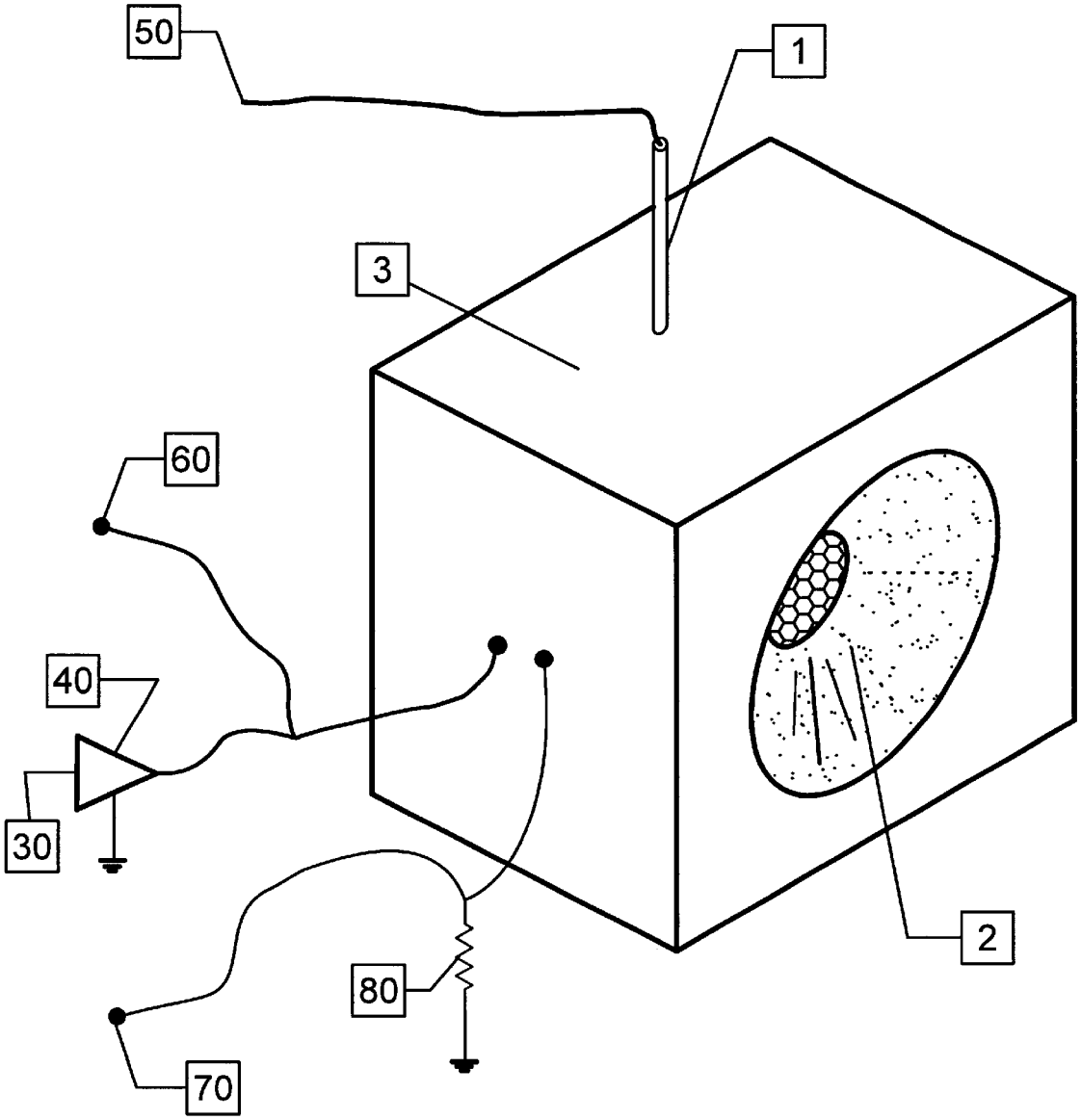
FIG. 2 shows a perspective drawing of the preferred embodiment of the novel measurement setup using a closed box.

Referring now to FIG. 2, there is shown a basic setup for the preferred embodiment of the measurement method which is the subject of this patent. In this figure, a measurement microphone 1, of standard design, is inserted into a test box 3 in which is also mounted a DUT 2. The test box is of simple construction, large enough to accommodate the DUT, but not excessively large. A rule of thumb is that the test box should be a rigid wooden cube with one face approximately two to three times the area of the DUT. The exact size is not critical so long as the exact volume is known. It may be desirable to have a few test boxes of different sizes so as to accommodate DUT's of different sizes. The box and fixtures attached to it (such as the DUT) must be sealed as well as possible for correct measurement.

The DUT is excited with an input signal 30, (which is typically broadband noise band limited to 0 –500 Hz.) which has been amplified by amplifier 40, of standard design. The output signal of the microphone 50 is recorded or analyzed using suitable equipment, including, but not limited to, a PC sound-card. A input voltage drop signal across the DUT 60 (measured relative to ground in the specific configuration of FIG. 2) is recorded or analyzed using suitable equipment. An input current flow signal into the DUT can be determined-from a sense signal 70 (measured relative to ground in the specific configuration of FIG. 2), measured across a sensing resistor 80. The sensing resistor is a standard type capable of handling the required power with a value typically around 1.0 Ohm. Any value of sensing resistance can be used, but it must be remembered that this resistance will appear in series with the DUT's $R_e$ and must therefor be subtracted from the $R_e$ as measured with the specific setup of FIG. 2. If the sensing resistors value is very small then this later complication can be ignored. The input current flow signal is calculated by dividing the sense signal voltage 70 by the value of the sense resistor and is recorded or analyzed using suitable equipment.

There are other configurations of connections and sense resistor locations which are similar to but not exactly the same as that shown in FIG. 2 which will also yield the input voltage and current for the DUT. These other configurations will be apparent to those skilled in the art, but in no way alter the procedure described in this application.

Figure 3:
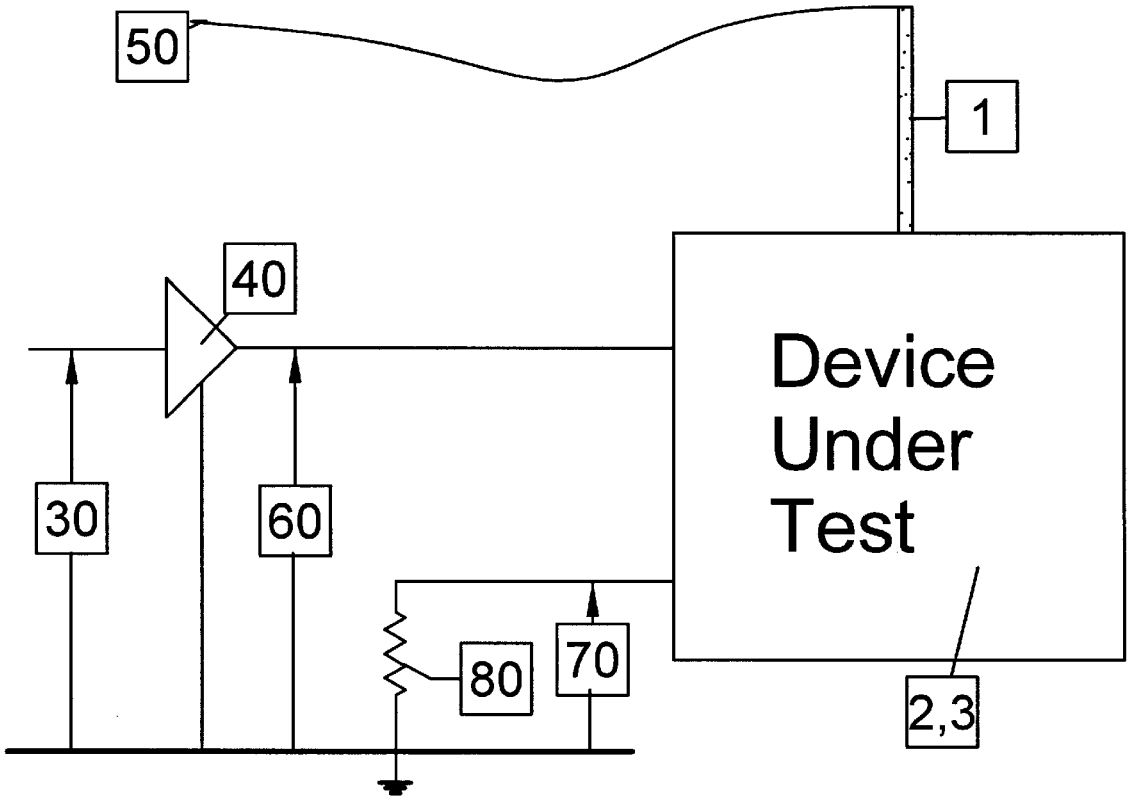
FIG. 3 is a flow diagram showing the process use to determine the transducers operating parameters.
Figure 4:
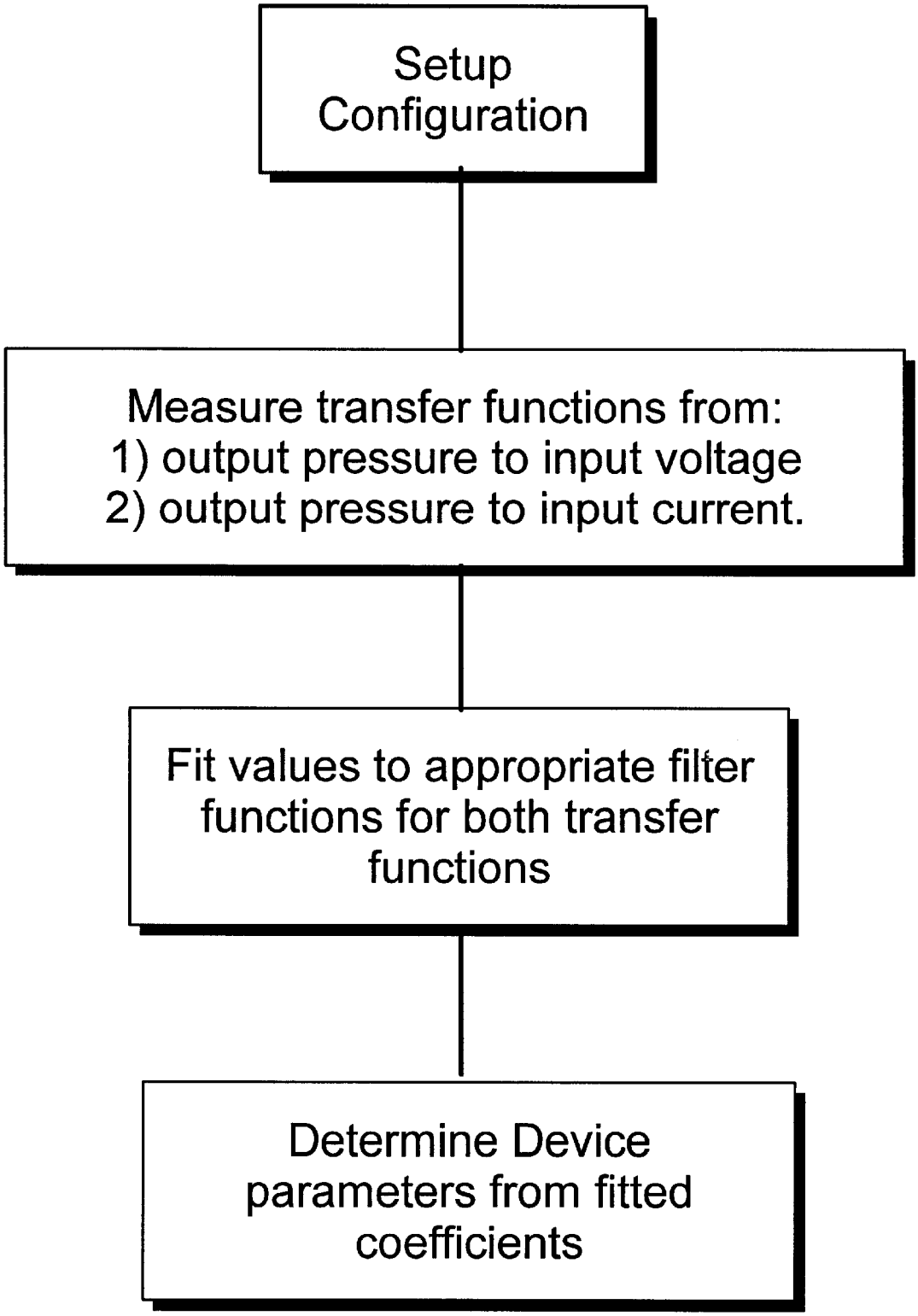
FIG. 4 shows a perspective drawing of the preferred embodiment of the novel measurement setup using a nearfield pressure measurement.
Figure 1:
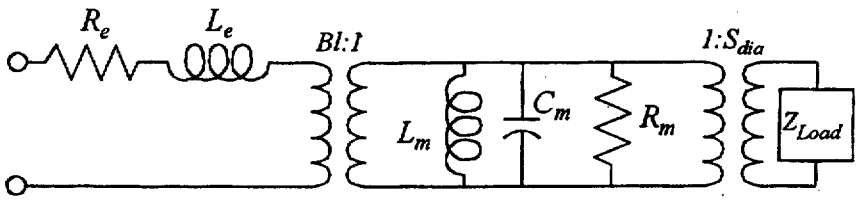
Figure 2:
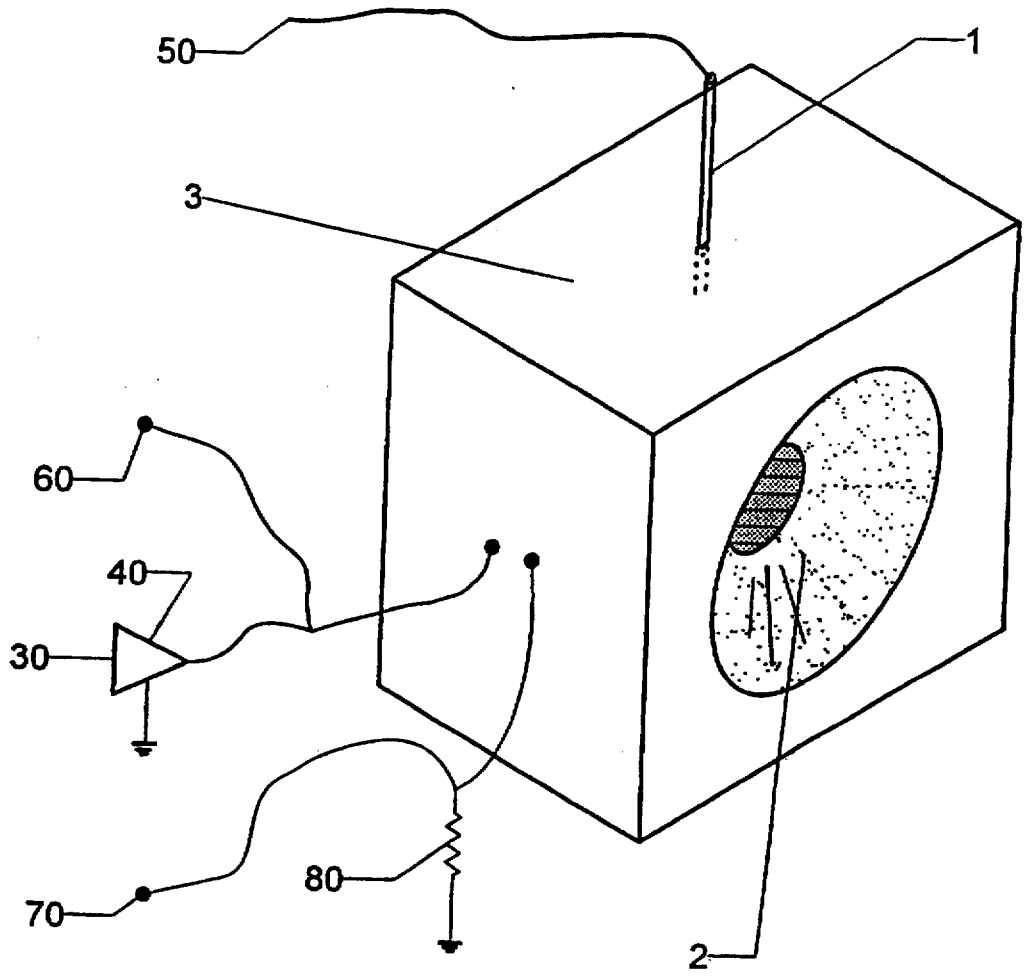
Figure 3:
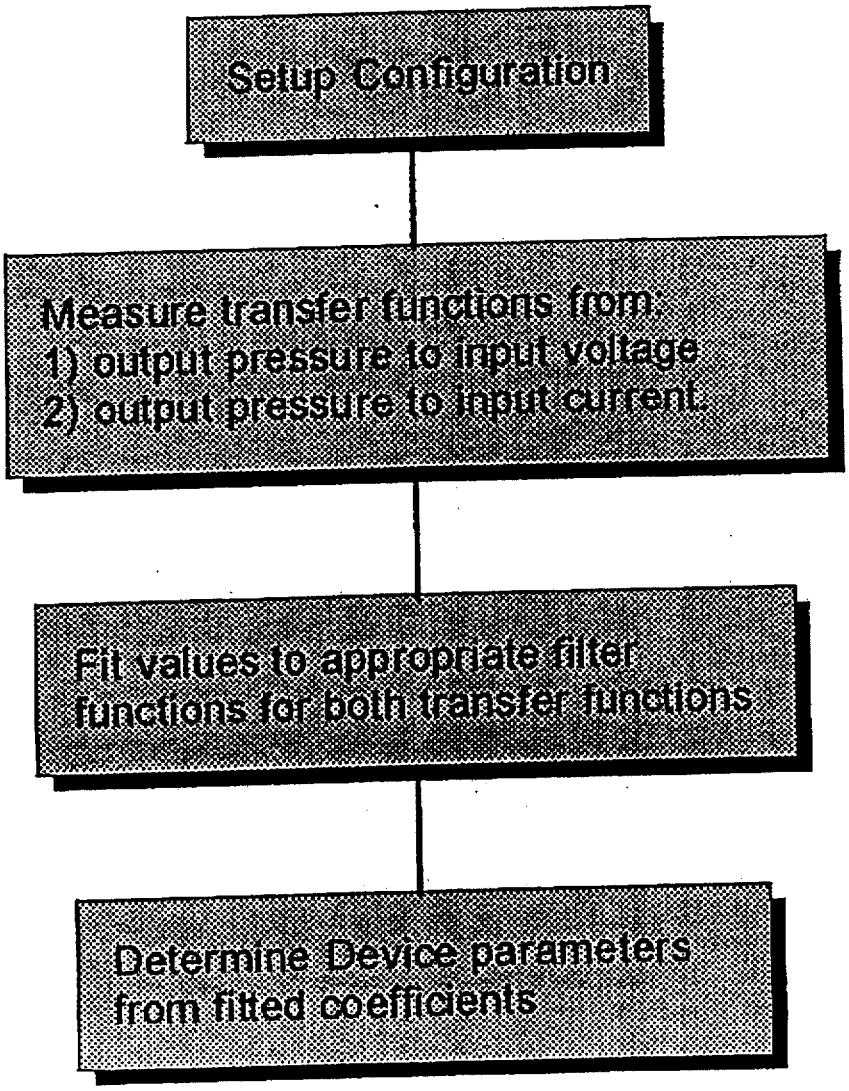
Figure 4:
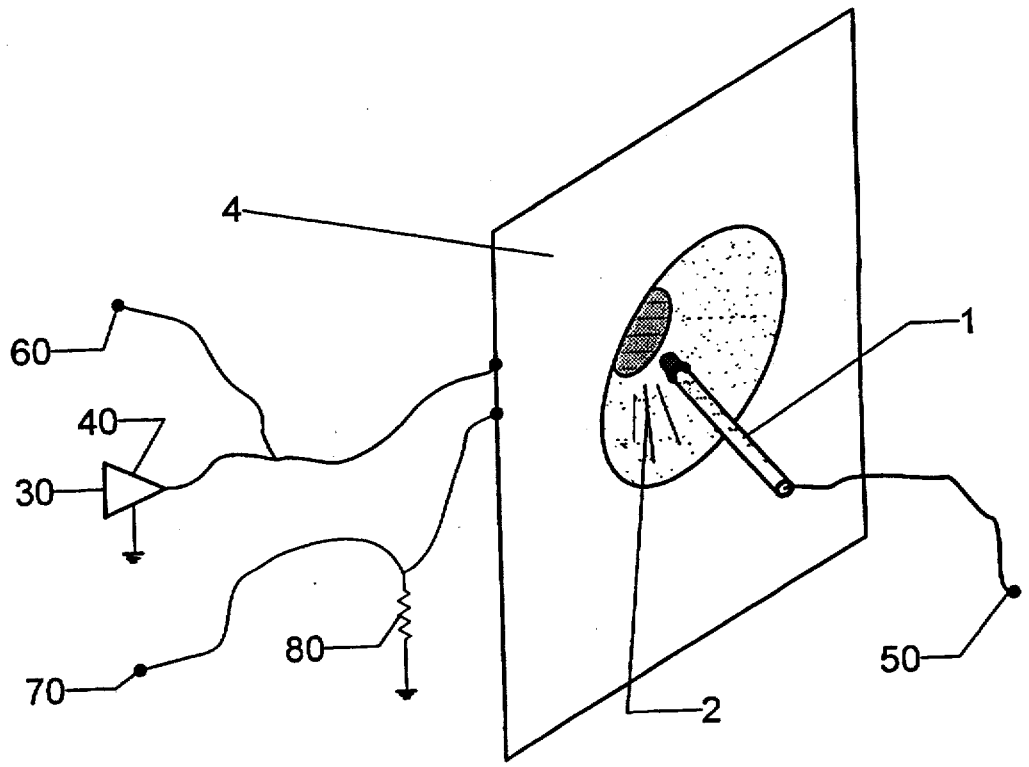

Using the data signals 50, 60 and 70 the calculation process is outlined in FIG. 3. First the transfer function from the voltage input to the test box pressure is calculated using standard techniques for signal processing. Next the transfer function from the input current to the test box pressure is likewise calculated. These transfer functions may be stored for later retrieval, but in any case their data must be available.

The transfer functions calculated above are the measured representations of EQS. 5. By using a statistical method of non-linear curve fitting, such as the Levenburg-Marquardt technique, the values of the constants b, d, e, f and g in EQ. 5 can be fit to the data from the measured transfer functions.

The five independent constants that are determined from this process are defined by the equations:

$$f = \frac{Bl \cdot S_d \cdot C_{ab}}{R_e \cdot C_b},\ b = C_{ab}\left(\frac{Bl^2}{R_e} + R_m\right) \tag{6}$$

$$g = \frac{Bl \cdot S_d \cdot C_{ab}}{C_b},\ d = R_m \cdot C_{ab}$$

$$e = \frac{1}{M_m \cdot C_{ab}}$$

It will be noted that there are five equations in six unknowns. To uniquely define the parameters of the DUT from the fitted values of b, . . . g one of the parameters of the DUT must know. The radiating area, $S_d$, is usually know, or is easily measured as in the prior art. With a directly measured $S_d$ a sufficient number of equations and constants exist to allow for the unique determination of the other five.

From the values of the constants we get:

$$Bl = \frac{(b-d)}{f \cdot C},\ C_{ab} = \frac{f \cdot g \cdot C^2}{(b-d)} \tag{7}$$

$$M_m = \frac{e \cdot (b-d)}{f \cdot g \cdot C^2},\ R_m = \frac{d \cdot (b-d)}{f \cdot g \cdot C^2}$$

$$R_e = \frac{g}{f}$$

where $$C = \frac{V}{S_d \cdot \rho \cdot c^2}.$$

The moving mass of the system, $M_m$ includes the radiation load and the mechanical compliance $C_{ab}$ includes the compliance of the rear box placed on the DUT.

The above calculation procedure is invariant under the different techniques disclosed in this application although the specific details may be different.

An alternative approach to measuring the pressure in a closed box of known volume is to measure the nearfield pressure of the driving unit. This setup is shown in FIG. 5. The DUT is mounted in a baffle 4. The baffle is of standard design and construction and its size is not critical as long as it is several times the area of the DUT itself The microphone 1 is placed very near to the radiating surface of the DUT 2 and very near its center. The same relative mathematics as above can be followed except that the relationship between the pressure and volume velocity now becomes (see Kinsler and Frey, *Fundamentals of Acoustics*, pg. 175, EQ. 7.63 with r=0 and ka small):

$$P(\omega) = \cdot \frac{i \cdot \omega \cdot \rho \cdot a}{S_d} U(\omega)$$

where the symbol a stands for the radius of the diaphragm of the DUT if it is round and $\sqrt{\text{area}/2\pi}$ if it is not round. This change in measurement of the pressure has the effect that it will change the transfer functions from the voltage and current to the pressure into high pass functions (as opposed to the low pass functions found in the closed box measurement).

In the case of the nearfield measurement of pressure the new set of equations (similar to those in EQ. 5) will be $$\frac{P(\omega)}{E(\omega)} = \frac{-\omega^2 \cdot \frac{Bl \cdot \rho \cdot a \cdot C_m}{R_e}}{1 - M_m \cdot C_m \cdot \omega^2 + i \cdot \omega \cdot \left(R_m + \frac{Bl^2}{R_e}\right) \cdot C_m} \tag{8}$$

$$= \frac{-\omega^2 \cdot c}{1 - e \cdot \omega^2 + i \cdot \omega \cdot b}$$

$$\frac{P(\omega)}{I(\omega)} = \frac{-\omega^2 \cdot Bl \cdot C_m \cdot \rho \cdot a}{1 - M_m \cdot C_m \cdot \omega^2 + i \cdot \omega \cdot R_m \cdot C_m}$$

$$= \frac{-\omega^2 \cdot f}{1 - e \cdot \omega^2 + i \cdot \omega \cdot d}$$

Following through on the derivation, as before, yields for the determination of the parameters from the fitted coefficients b, d, e, f and g as follows:

$$Bl = \frac{(b-d)}{f} \cdot \rho \cdot a,\ C_m = \frac{g \cdot f}{(b-d) \cdot (\rho \cdot a)^2} \tag{9}$$

$$M_m = \frac{e \cdot (b-d)}{g \cdot f} \cdot (\rho \cdot a)^2,\ R_m = \frac{d \cdot (b-d)}{g \cdot f}(\rho \cdot a)^2$$

$$R_e = \frac{g}{f}$$

In the above equations the acoustic mass load on the diaphragm due to the radiation has been absorbed into the cone mass term, as is usual. EQS. 9 will be seen to be virtually identical to the set of EQS. 7 except that a different load is placed on the system represented by pa for the nearfield case and the value $C^l$ in the closed box case.

It is also possible to eliminate the pressure P(ω) by using the relationship between the far field pressure and the cone volume velocity. The algebra is straightforward and would lead to a nearly identical set of equations as the nearfield case A plane wave tube can also be placed over the DUT and a microphone used to measure the pressure in the tube. In this case another nearly identical set of equations results except that they would need to be fitted to a bandpass filter function.

It can be seen that any technique that uses a pressure signal will result in a nearly identical set of equations which define the ttrasducer parameters characterized by the undetermined coefficients of some second order filter form. The only difference is that these undetermined coefficients will be described a different filter function. In practice these differing style of functions may result in better resolution of the parameters.

The radiating surface volume velocity can also be calculated by the use of a two microphone output measurement in a plane wave tube. The difference of the two microphone measurements is proportional to the gradient of the pressure, or the volume velocity. The advantage of the two microphone technique is that it calculates the volume velocity directly even if there are standing waves in the tube. The details of this technique can be found in Riggs and Geddes "A Two Microphone Technique for Measuring Acoustic Waveguide Impedance" AES Preprint #2878 presented at the AES convention in October 1989 and the associated references.

Another possible loading configuration that is of use is that of a fixed plate clamped onto the front of the radiating transducer. In this configuration the load can be assumed to be that of a very large resistance and that the volume velocity of the transducer will be zero. This simplifies EQS. 2 to $$I(\omega) = \frac{Bl}{S_d} \cdot P(\omega)$$

or $$\frac{I(\omega)}{P(\omega)} = \frac{Bl}{S_d}$$

From this equation it is clear that this complex spectral ratio should be a constant. If this transfer function does not produce a flat spectrum then the assumptions of zero volume velocity have been violated. This can occur for DUT's with significant leakage around the radiating member. If on the other hand there is a range of approximately flat response then the value of this response is the ratio of the drive constant Bl and the radiating area, $S_d$.

It will also be apparent that a combination of the prior art and the current preferred embodiment can be used to improve the testing capabilities even more. By perturbing the system, for example using two test boxes of different volumes, a test box and the nearfield, etc., even more equations in the same number of unknowns are available. The extra equations can be used to calculate $S_d$ directly from the data as opposed to having to be entered as a known quantity.

I claim as my invention:

1. Measurement apparatus comprising:

an acoustic transducer having an input and sound radiating output; and a test setup comprising;

a means for generating an input signal to said transducer;

a means for sensing a voltage drop signal across said transducer resulting from said input signal;

a means for sensing a current flow signal into said transducer resulting from said input signal;

a means for sensing an acoustic pressure output signal from said transducer;

a means for calculating transfer functions from said output pressure to the two said electrical input signals; and a means for determining a set of coefficients describing said transfer functions;

whereby said transducer's linear operational parameters can be calculated from said determined coefficients.

2. The measurement apparatus of claim 1 wherein the means to sense the acoustic pressure output signal comprises;

a rigid sealed housing which surrounds one side of said acoustic transducer; and a microphone to sense the radiated sound pressure level inside of said housing.

3. The measurement apparatus of claim 1 wherein the means to sense the acoustic pressure output signal comprises, a rigid baffle with acoustic transducer sealingly installed onto one side and, a microphone place near the center of the acoustic transducers radiating surface.

4. The measurement apparatus of claim 1 wherein;

a plane wave tube is sealingly attached to a radiating face of said acoustic transducer; and one or more microphones are placed inside of said tube.

5. The measurement apparatus of claim 1 wherein;

a rigid seated housing is attached to one side of said acoustic transducer in such a way that a very small volume results; and a microphone placed inside said small sealed housing is used to determine the acoustic transducers force coupling factor times its radiating area.

6. A measurement apparatus comprising;

an acoustic transducer having an input and sound radiating output and;

a test setup having;

a means for inputting a signal of known frequency to said transducer;

a means for sensing an input voltage drop across said transducer at said frequency;

a means for sensing an input current flow into said transducer at said frequency;

a means for sensing the radiated sound pressure level of said transducer at said frequency; and a means for calculating equations using specific frequencies, whereby said acoustic transducer's linear operational parameters can be determined.

7. The measurement apparatus of claim 6 wherein the means to sense the acoustic pressure output signal comprises;

a rigid sealed housing which surrounds one side of said acoustic transducer; and a microphone to sense the radiated sound pressure level inside of said housing.

8. The measurement apparatus of claim 6 wherein the means to sense the acoustic pressure output signal comprises, a rigid baffle with acoustic transducer sealingly installed onto one side and, a microphone placed at or near the center of the acoustic transducers radiating surface.

9. The measurement apparatus of claim 6 wherein;

a plane wave tube is sealingly attached to a radiating face of said acoustic transducer; and one or more microphones are placed inside of said tube.

10. The measurement apparatus of claim 6 wherein;

a rigid sealed housing is attached to one side of said acoustic transducer in such a way that a very small volume results; and a microphone placed inside said small sealed housing is used to determine the acoustic transducers force coupling factor times its radiating area.

11. A measurement method comprising;

taking a transfer function from the output pressure response to the input voltage of an acoustic transducer;

taking a transfer function from the output pressure response to the input current of an acoustic transducer;

and calculating the linear parameters of said acoustic transducer using a computer or suitable calculator.

12. A measurement method comprising;

inputting a sine wave of known frequency to an acoustic transducer;

sensing the voltage drop across said transducer at said frequency;

sensing the current flow into said transducer at said frequency;

sensing the radiated sound pressure level of said transducer at said frequency;

and calculating said acoustic transducers linear operational parameters using said specific frequencies.

* * * * *

UNITED STATES PATENT AND TRADEMARK OFFICE

CERTIFICATE OF CORRECTION

PATENT NO. : 6,269,318 B1
DATED : July 31, 2001
INVENTOR(S) : Geddes

It is certified that error appears in the above-identified patent and that said Letters Patent is hereby corrected as shown below:

Title page,
The title page, showing the illustrative figure, should be deleted and substitute therefore the attached title page.

The Drawing Sheets, consisting of Figs. 1-4, should be deleted to be replaced with the four (4) drawing sheets, as shown on the attached pages.

Signed and Sealed this

Fifth Day of February, 2002

*Attest:*

*Attesting Officer*

JAMES E. ROGAN
*Director of the United States Patent and Trademark Office*

(12) United States Patent
Geddes

(10) Patent No.: US 6,269,318 B1
(45) Date of Patent: Jul. 31, 2001

(54) METHOD FOR DETERMINING TRANSDUCER LINEAR OPERATIONAL PARAMETERS

(76) Inventor: Earl R. Geddes, 1388 Medinah Dr., Itasca, IL (US) 60143

( * ) Notice: Subject to any disclaimer, the term of this patent is extended or adjusted under 35 U.S.C. 154(b) by 0 days.

(21) Appl. No.: 09/058,441

(22) Filed: Apr. 9, 1998

Related U.S. Application Data

(60) Provisional application No. 60/044,299, filed on Apr. 30, 1997.

(51) Int. Cl.[7] ..... H04R 3/00; H04R 29/00

(52) U.S. Cl. ..... 702/109; 381/150; 324/615; 324/629

(58) Field of Search ..... 702/109, 65, 86, 702/103, 107; 324/612, 615, 629; 73/1.82, 645; 381/95, 96, 150

(56) References Cited

U.S. PATENT DOCUMENTS

| | | | | |
|---|---|---|---|---|
| 3,912,880 | * | 10/1975 | Powter et al. | 179/175.1 A |
| 4,209,672 | * | 6/1980 | Nitta et al. | 179/175.1 |
| 4,284,860 | * | 8/1981 | Leach, Jr. et al. | 179/175.1 |
| 4,403,112 | * | 9/1983 | Modafferi | 179/1 E |
| 4,909,064 | * | 3/1990 | Talmadge | 73/4 R |
| 5,181,251 | * | 1/1993 | Schultheiss et al. | 381/96 |
| 5,361,305 | | 11/1994 | Easley . | |
| 5,438,625 | * | 8/1995 | Klippel | 381/96 |
| 5,491,753 | | 2/1996 | Van Hoot . | |
| 5,792,072 | * | 8/1998 | Keefe | 600/559 |

OTHER PUBLICATIONS

Various Internet Pages From: www.etfacoustic.com, Date Unknown.*

Thiele "Loudspeakers in Vented Boxes: Part I" Loudspeaker Anthology—AES Orginally–Proceediongs of the IREW Australia, vol. 22 p. 487 Aug. 1961.

Small "Direct–Radiator Loudspeaker System Analysis" Loudspeaker Anthology–AES Orginally—IEEE Transactions on Audio and Electroacoustics vol. AU–19 p. 269, Dec. 1971.

Jeong "Harmonic Balance Methode for Estimating the Non–Linear Parameters of Electro Dynamic Direct Radiator Loudspeakers" Journal of the Audio Engineering Society vol. 44 #4, Apr. 1996.

Phillips "Efficient Loudspeaker Linear and Non–Linear Parameter Estimination" AES Preprint #3164 Presented at the 93rd AES Convention, Oct. 1992.

* cited by examiner

*Primary Examiner*—Patrick Assouad

(57) ABSTRACT

An apparatus and method for determining a transducers principle operating parameters which utilizes two transfer functions; 1) the transfer function from the pressure response (50) to the voltage drop across the transducer (60); and 2) the transfer function from the pressure response (50) to the current flow through the transducer(70). The parameters of simple filter equations are fitted to these measured response curves. The transducers operating parameters are then calculated directly from the fitted parameters of the filter equations. Several methods for measuring the pressure and determining the appropriate filter equations are shown.

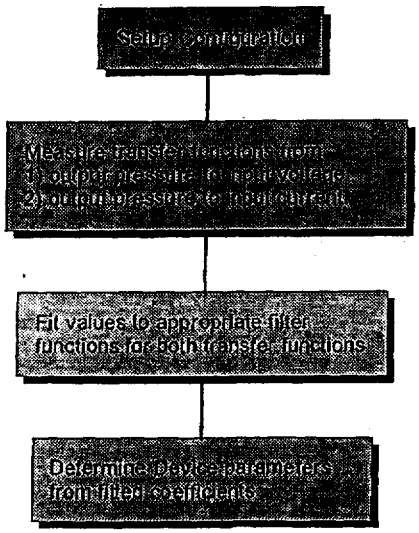

12 Claims, 4 Drawing Sheets